US006779219B1

(12) United States Patent
Young et al.

(10) Patent No.: US 6,779,219 B1
(45) Date of Patent: Aug. 24, 2004

(54) SLIDING WINDOW CLEANING TOOL

(76) Inventors: Edward B. Young, P.O. Box 1788, Ft. Myers, FL (US) 33902; Cynthia T. Young, P.O. Box 1788, Ft. Myers, FL (US) 33902

( * ) Notice: Subject to any disclaimer, the term of this patent is extended or adjusted under 35 U.S.C. 154(b) by 0 days.

(21) Appl. No.: 10/386,409

(22) Filed: Mar. 12, 2003

(51) Int. Cl.[7] ..... A47L 1/06; A47L 13/12; A47L 13/02

(52) U.S. Cl. ..... 15/105; 15/111; 15/220.1

(58) Field of Search ..... 15/111, 105, 220.1; D4/118

(56) References Cited

U.S. PATENT DOCUMENTS

| | | | | | |
|---|---|---|---|---|---|
| 726,208 | A | * | 4/1903 | Wilson | 15/105.52 |
| 2,405,029 | A | * | 7/1946 | Gallanty et al. | 606/161 |
| 2,464,321 | A | * | 3/1949 | Konczal | 15/167.1 |
| 2,576,325 | A | * | 11/1951 | Wood | 15/111 |
| 3,199,139 | A | * | 8/1965 | Vallis | 401/22 |
| D203,742 | S | * | 2/1966 | Roberts | D4/118 |
| 4,858,266 | A | * | 8/1989 | Engstrom | 15/111 |
| 5,323,506 | A | * | 6/1994 | Babitch | 15/210.1 |
| 5,351,350 | A | * | 10/1994 | Johnson | 7/105 |
| 5,875,511 | A | * | 3/1999 | Nejdl | 15/176.1 |
| 5,980,541 | A | * | 11/1999 | Tenzer | 606/161 |
| 6,276,023 | B1 | * | 8/2001 | Grundy | 15/244.1 |
| 6,550,996 | B1 | * | 4/2003 | Rayfield | 401/6 |

* cited by examiner

*Primary Examiner*—Randall Chin

(57) ABSTRACT

The invention is used as a tool for cleaning horizontal channels in window sections that slide relative to each other. It is well known that such channels are very difficult to clean because of the close proximity of the individual window sections unless the whole window combination is taken apart. The tool consists of a thin blade having at one end thereof a hook to scrape away dirt that is lodged in the bottom of the channel. The other end of the blade has various brush elements mounted thereon that sweep the dirt or debris from out of the channel when the tool is slipped in between the windows.

4 Claims, 3 Drawing Sheets

SLIDING WINDOW CLEANING TOOL

BACKGROUND OF THE INVENTION

The invention includes a hand held tool that is most useful when cleaning windows that slide relative to each other. Such sliding windows have an upper window section and a lower window section. In most instances the upper window section is stationary while the lower window section can move up and down relative to the lower section. The individual window sections are normally constructed of either vinyl or aluminum channel members. Once the individual window sections are assembled and then installed in a completed window assembly, the channels into which the glass panels are guided and then fastened, leave channels which are open in an upward direction. It has been found that the upwardly open channels collect dirt and debris which may be derived from the initial installation of the building or at a later date by wind-born currents. It is almost impossible to clean these channels because of the close proximity of the two window sections that move relative to each other. For the average home owner it is impossible to remove the window sections out of the window frame for cleaning purposes. Therefore the above mentioned tool has been developed to ease the task of cleaning.

BRIEF SUMMARY OF THE INVENTION

The inventive tool is very simple to use, is very effective and will easily slip between the two window sections that slide relative to each other. The tool is a blade that has on one end thereof a sharpened hook that is capable of dislodging hardened debris while the other end has a brush-like element for sweeping away any dirt that is located in the channel. There are shown different brush elements that may enhance the sweeping motion depending on the construction shape of the individual channels of the different window sections.

DETAILED DESCRIPTION OF THE INVENTION

Figure 1:
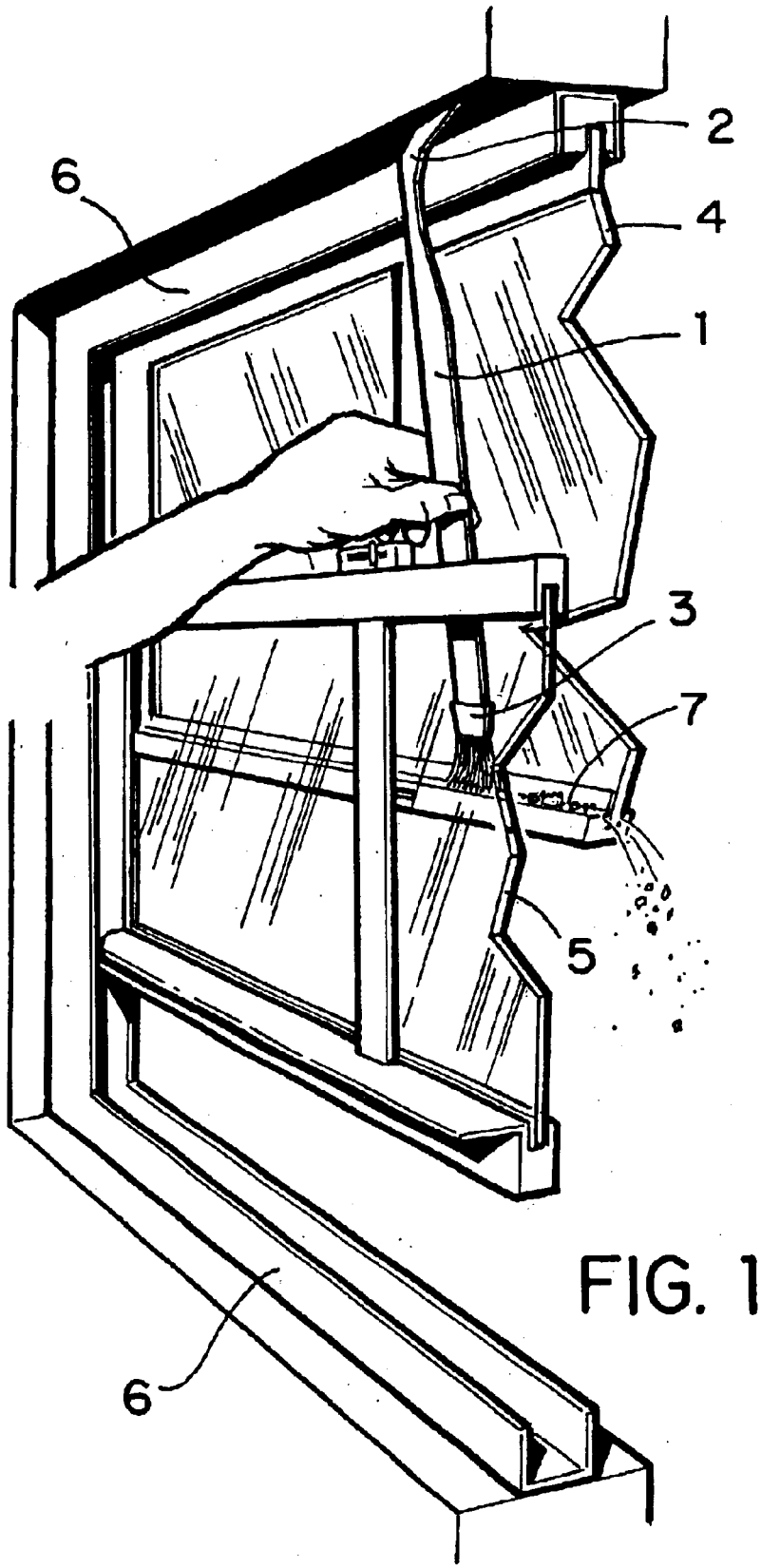
FIG. 1 is a perspective view of a window including the use of the tool.

FIG. 1 illustrates the use of the tool 1 in a perspective view. The tool is shown as a blade at 1 as it has been moved in-between the two window sections, the upper one at 4 and the lower one at 5. Both window sections 4 and 5 move relative to each other in the main window frame 6. As can be seen, the dirt and debris that has collected in the lower channel 7 of the upper window section 4 cannot be removed unless the whole window assembly has been disassembled. The tool 1 can easily slip between the two window sections 4 and 5 and can sweep away the dirt in the lower channel 7 of the upper window section 4.

Figure 2:
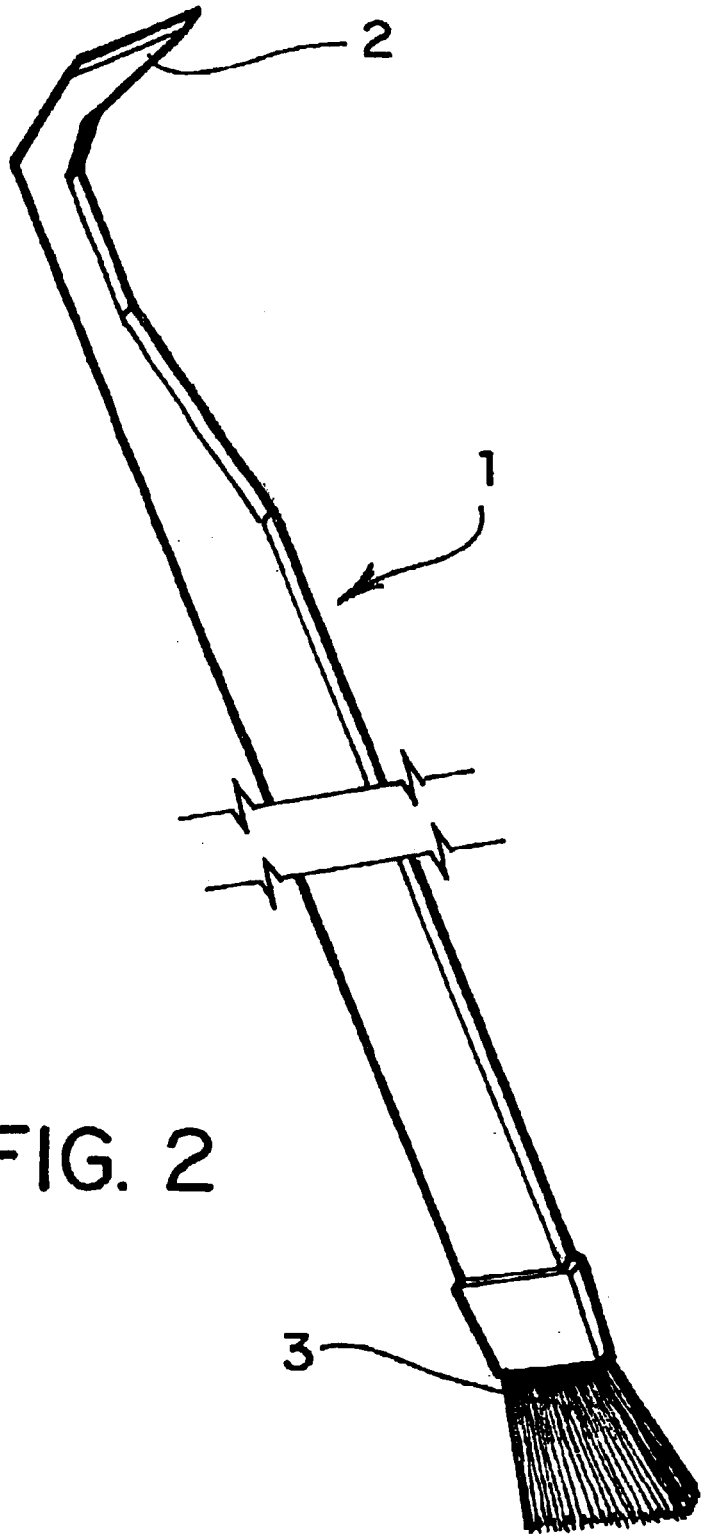
FIG. 2 shows the tool itself.

FIG. 2 illustrates the tool 1 as having at one end thereof a scraper-like hook 2 and a brush element 3 at another end. The tool 1 should be made of a relatively hard material such a sheet metal or aluminum or a plastic material. The tool should be thin enough so that it can easily slip between the two window sections 4 and 5. On the other hand, the tool should be flexible enough to accommodate any small misalignment between the two window sections 4 and 5.

Figure 3:
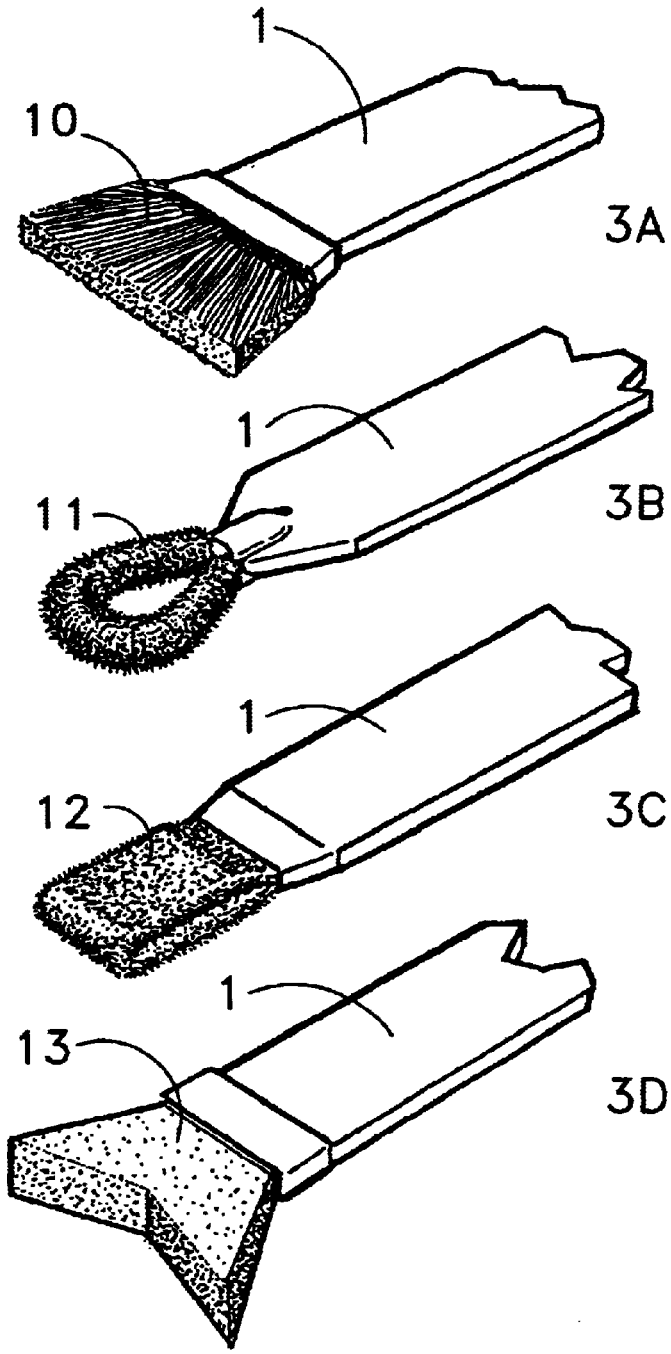
FIGS. 3A–3D illustrate various brush end profiles for one end of the tool.

FIGS. 3A–3D show different profiles of different brush elements. FIG. 3A shows a flat brush element 10 which would be useful in most instances having a multiple of bristles FIG. 3B shows an oval-shaped brush element 11 which would be most useful in removing in removing coarse dirt and debris including the side walls of the respective channel.

FIG. 3C shows a double-backed brush 12 in the form of foam rubber. This type of brush would be most useful in washing the channel 7 of FIG. 1.

FIG. 3D shows a brush element 13 which is rather stiff and is most useful when encountering baked-on dirt that the hook element 2 at the other end of the tool cannot dislodge. This brush element could be made of a coarse foam rubber.

All the brush elements 3A–3D or 10–13 should be fastened to the end of tool 1 in such a way that they can easily be exchanged for each other as the need arises. This can be done by form fitting receptacles or snap fittings.

We claim:

1. A cleaning tool for cleaning channels in window sections that slide relative to each other, said tool comprising a thin but relatively stiff and elongated blade having at one end thereof a hooked element for scraping dirt that is lodged in a bottom of said channel, said other end of said tool having a brush element thereon for sweeping away said dirt located in said bottom of said channel, wherein said brush element is a double-backed piece of foam rubber.

2. The cleaning tool of claim 1 wherein said brush element includes multiple of bristles.

3. The cleaning tool of claim 1 wherein said brush element has the shape of an oval brush element.

4. The cleaning tool of claim 1, wherein said brush element is a coarse piece of foam rubber.

* * * * *